US007823231B2

(12) United States Patent
Paoutoff

(10) Patent No.: US 7,823,231 B2
(45) Date of Patent: Nov. 2, 2010

(54) STRUCTURE FOR A PIECE OF FURNITURE SUCH AS A RETRACTABLE BED, WITH RETRACTABLE LEGS

(76) Inventor: Alexis Paoutoff, RN 532, 38680 Saint Just de Claix (FR)

( * ) Notice: Subject to any disclaimer, the term of this patent is extended or adjusted under 35 U.S.C. 154(b) by 0 days.

(21) Appl. No.: 11/885,874

(22) PCT Filed: Feb. 27, 2006

(86) PCT No.: PCT/FR2006/000432

§ 371 (c)(1),
(2), (4) Date: Oct. 11, 2007

(87) PCT Pub. No.: WO2006/095073

PCT Pub. Date: Sep. 14, 2006

(65) Prior Publication Data

US 2008/0163422 A1 Jul. 10, 2008

(30) Foreign Application Priority Data

Mar. 7, 2005 (FR) ..... 05 02264

(51) Int. Cl.
*A47C 17/38* (2006.01)

(52) U.S. Cl. ..... 5/136; 5/133; 5/168; 5/310

(58) Field of Classification Search ..... 5/133, 5/136, 159.1, 160, 168, 137, 139, 162, 163, 5/167, 2.1, 3, 310, 311, 315.2
See application file for complete search history.

(56) References Cited

U.S. PATENT DOCUMENTS 1,366,521 A * 1/1921 Conhaim ..... 5/136
5,446,932 A * 9/1995 Voorhis ..... 5/137

FOREIGN PATENT DOCUMENTS

| | | |
|---|---|---|
| DE | 10 73 176 B | 1/1960 |
| GB | 181995 A | 6/1922 |
| GB | 1 464 852 A | 2/1977 |

* cited by examiner

*Primary Examiner*—Robert G Santos
*Assistant Examiner*—Nicholas Polito
(74) *Attorney, Agent, or Firm*—Young & Thompson

(57) ABSTRACT

A structure for a piece of furniture, such as a retractable bed, includes a fixed part and a pivoting part, the latter having an essentially flat frame and being hinged to the fixed part between an essentially vertical raised position and an essentially horizontal lowered position. The pivoting part includes at least one guide which extends approximately at right angles to the frame and at least one leg mounted on this guide in such a way as to slide, with an actuating device connecting the leg to the fixed part to move the leg between an extended position when the pivoting part is in the lowered position in such a way that its free end is standing on the floor and a withdrawn position when the bed is in its raised position.

11 Claims, 8 Drawing Sheets

STRUCTURE FOR A PIECE OF FURNITURE SUCH AS A RETRACTABLE BED, WITH RETRACTABLE LEGS

The present invention relates to furniture and more particularly to retractable beds.

These usually comprise one part which is fixed and one part which pivots relative to the fixed part and is designed to occupy a horizontal lowered position of use in which the pivoting part extends forward, and a folded position in which the pivoting part is raised vertically. The fixed part and the pivoting part are provided with enclosing means such that in the folded position they give the appearance of a wardrobe. The enclosing means of the pivoting part comprise a projecting rim consisting of a leg which stands on the floor when in the lowered position.

It is an object of the present invention to provide another way of supporting the pivoting part on the floor when in the lowered position.

The subject of the present invention is a structure for a piece of furniture, such as a retractable bed, which comprises a fixed part and a pivoting part, the latter comprising an essentially flat frame and being hinged to the fixed part between an essentially vertical raised position and an essentially horizontal lowered position.

According to the invention, said pivoting part comprises at least one guide which extends approximately at right angles to said frame and at least one leg mounted on this guide in such a way as to slide, with actuating means connecting said leg to said fixed part to move said leg between an extended position when said pivoting part is in the lowered position in such a way that its free end is standing on the floor and a withdrawn position when the bed is in its raised position.

In accordance with the invention, the pivoting part preferably comprises a front wall which faces the floor when in its lowered position, said leg extending through this front wall in such a way that in the withdrawn position its free end is close to this front wall.

In accordance with the invention, said front wall and said frame preferably define a space in which said actuating means are located.

In accordance with the invention, the structure preferably comprises a limit-of-travel and/or collapse-prevention stop that acts on the leg when the leg is in its extended position.

In accordance with the invention, said actuating means preferably comprise a member pivoting on the pivoting part, this member comprising two arms, of which a first arm is connected to the leg by a first link and a second arm is connected to the fixed part by a second link.

In accordance with the invention, when said leg is both in its extended position and in its withdrawn position, the transverse hinge pin connecting the second arm to the second link is preferably not aligned with the transverse hinge pin connecting this second link to said fixed part and the transverse hinge pin connecting said member to said pivoting part.

In accordance with the invention, when said leg moves between its extended position and its withdrawn position, the transverse hinge pin connecting the second arm to the second link is preferably on one side of the plane passing through the transverse hinge pin connecting this second link to said fixed part and the transverse hinge pin connecting said member to said pivoting part.

In accordance with the invention, the structure preferably comprises means such that said first arm and said first link produce a toggle action when said leg is in its extended position.

In accordance with the invention, the fixed part preferably comprises a stop to limit the travel of said first arm and said first link such that said first arm and said first link produce a toggle action when said leg is in its extended position.

In accordance with the invention, said guide preferably comprises a tubular part in which said leg slides.

In accordance with the invention, said tubular part and said leg preferably have square cross sections.

In accordance with the invention, the free end of said leg preferably has an end plate which is close to or in contact with the front face of said front wall when said leg is moved into its withdrawn position.

In accordance with the invention, the length of said leg is preferably adjustable.

According to the invention, said fixed part may advantageously comprise two side boards and said pivoting part comprises a frame, this frame being supported by said fixed part via a transverse hinge pin, said side boards being connected by a transverse reinforcing bar connected to these boards and located in a region situated below said pivot pin, said actuating means being connected to this reinforcing bar.

One particular embodiment of a folding bed structure according to the present invention will now be described as a non-restrictive example illustrated in the drawing, in which.

Figure 1:
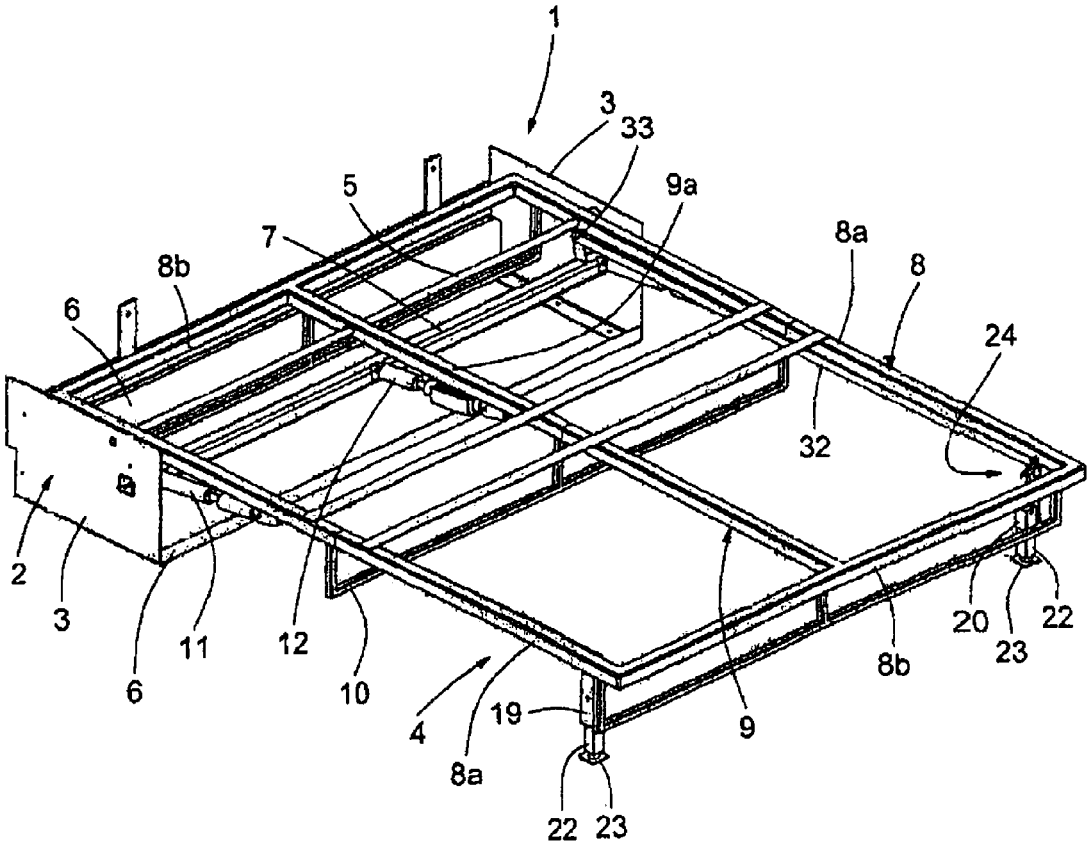
FIG. 1 is a perspective view, in the lowered position, of a structure for a retractable bed base in accordance with the invention.
Figure 2:
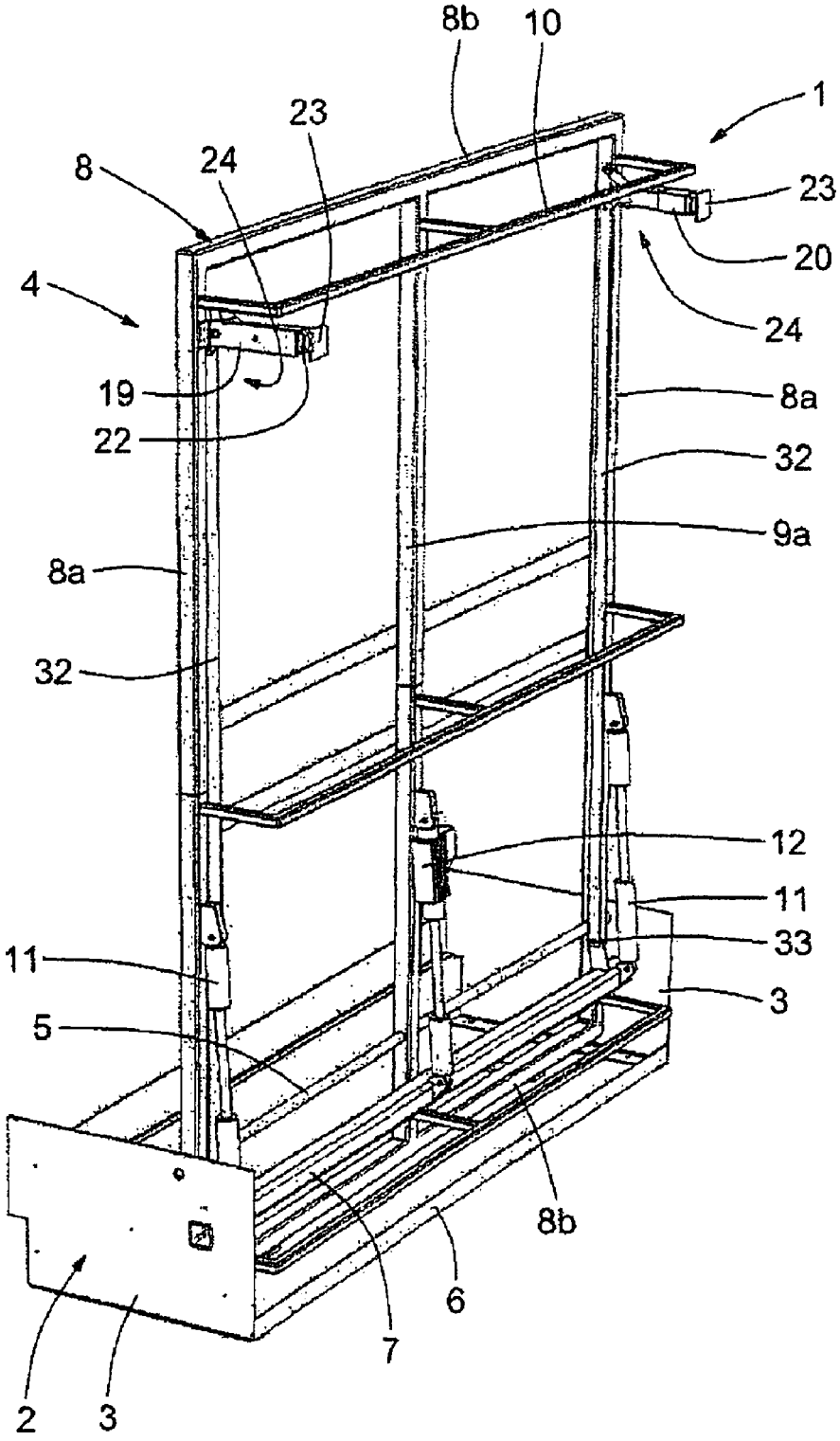
FIG. 2 is a perspective view, in the raised or folded position, of the base structure seen in FIG. 1.
Figure 3:
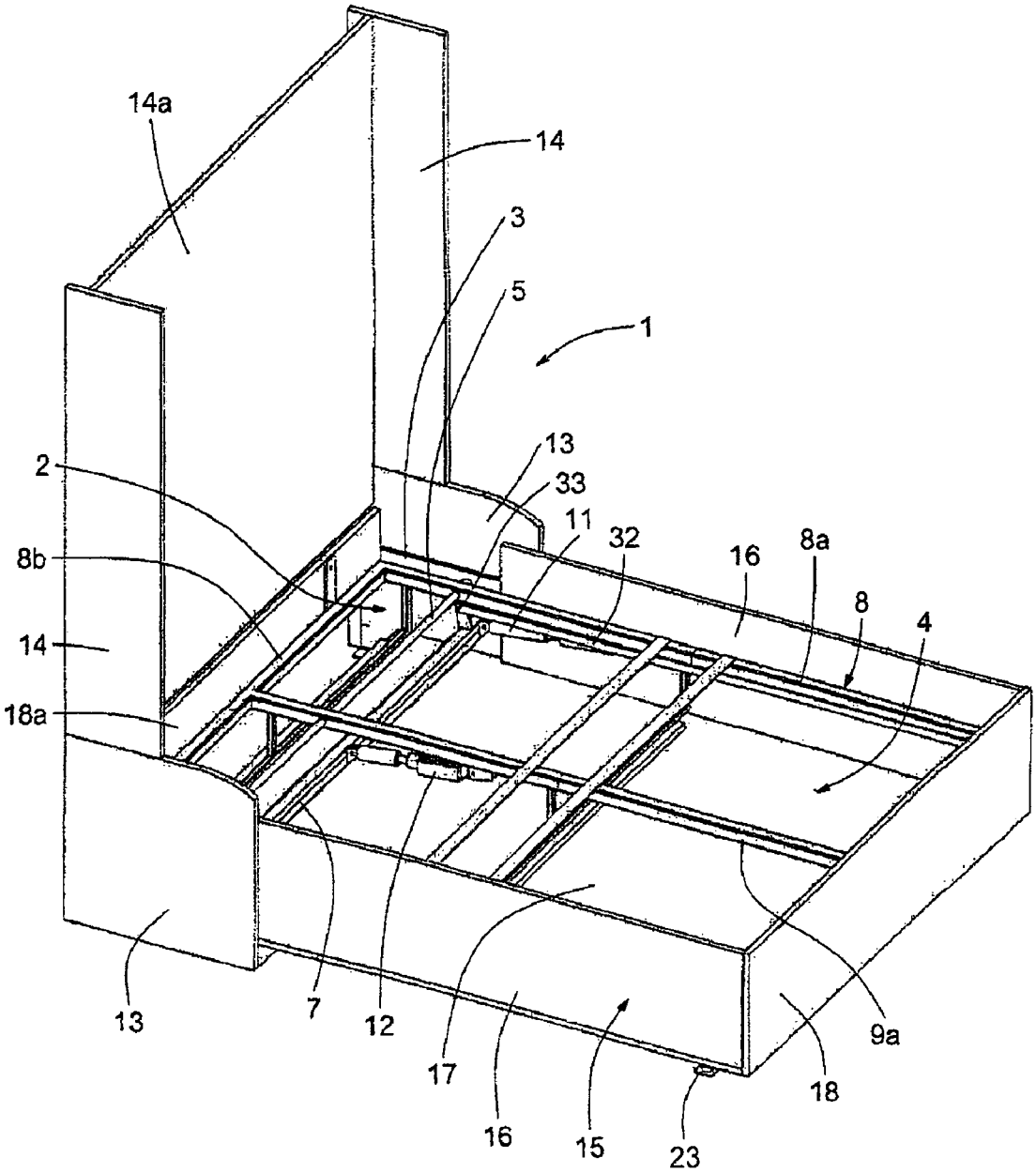
FIGS. 3 and 4 are perspective views, in the lowered and raised positions, respectively, of the aforementioned base structure, fitted with enclosing means.
Figure 4:
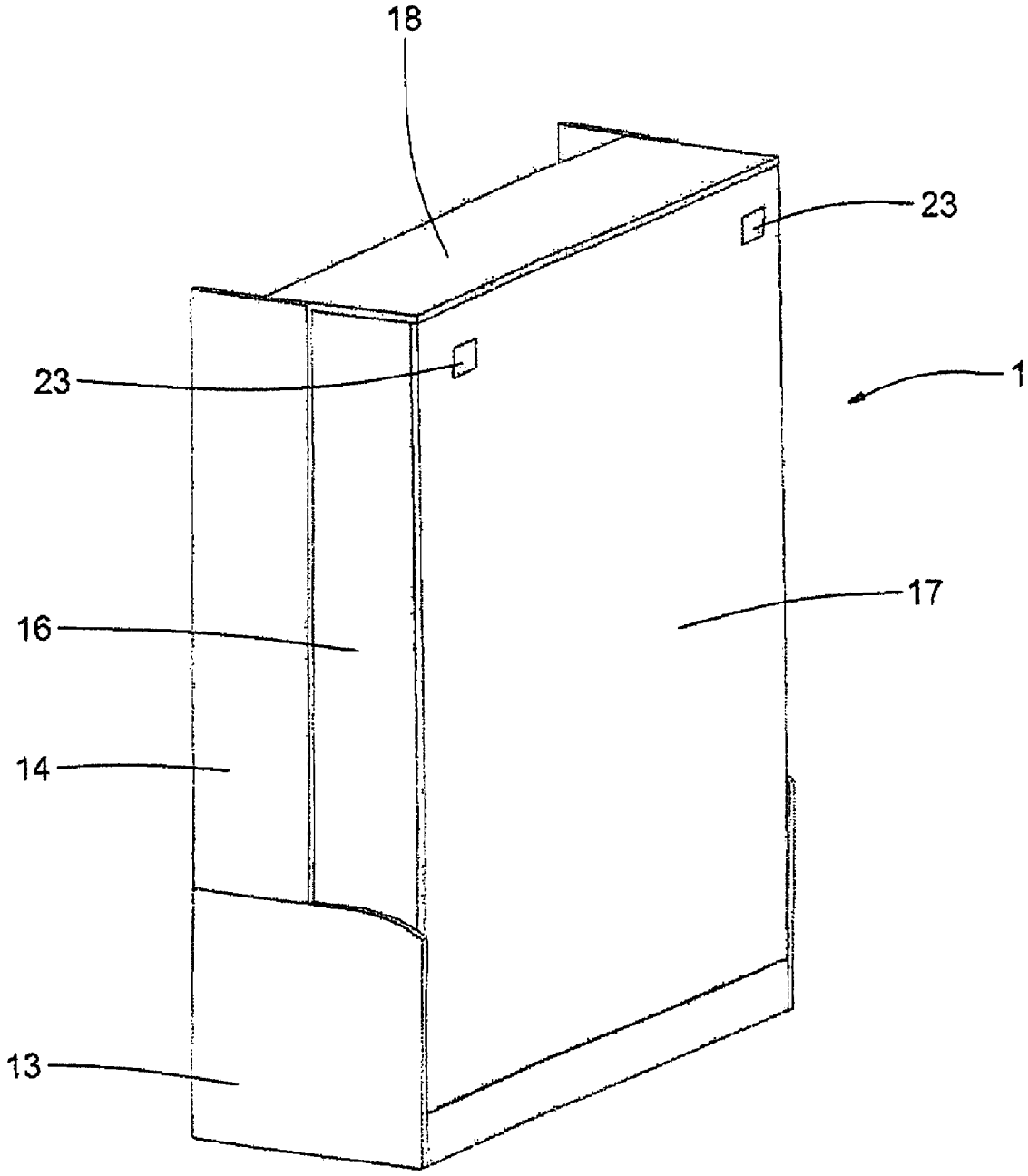
Figure 5:
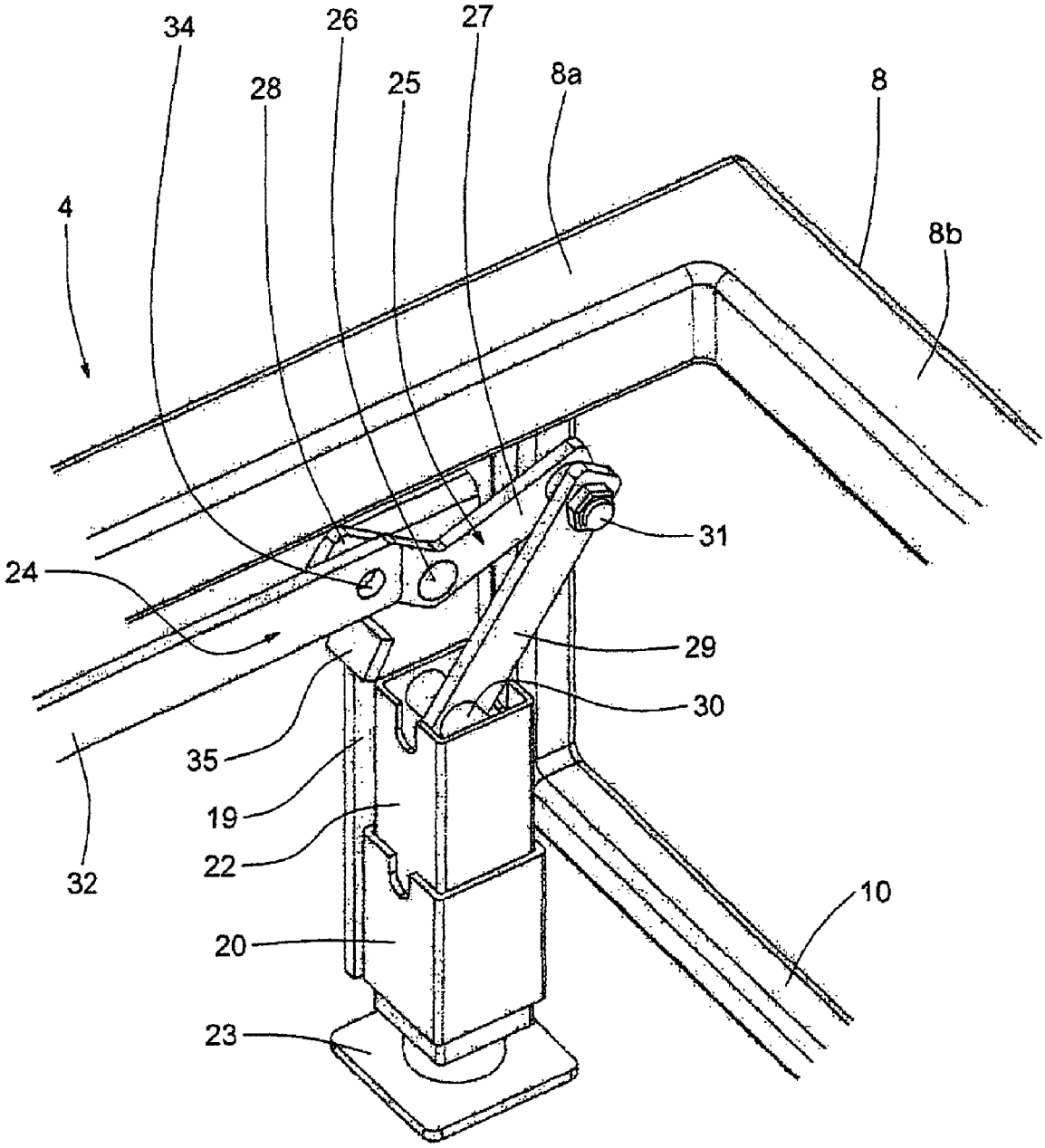
FIG. 5 is a partial perspective view of a leg and its actuating means used on the aforementioned structure.
Figure 6:
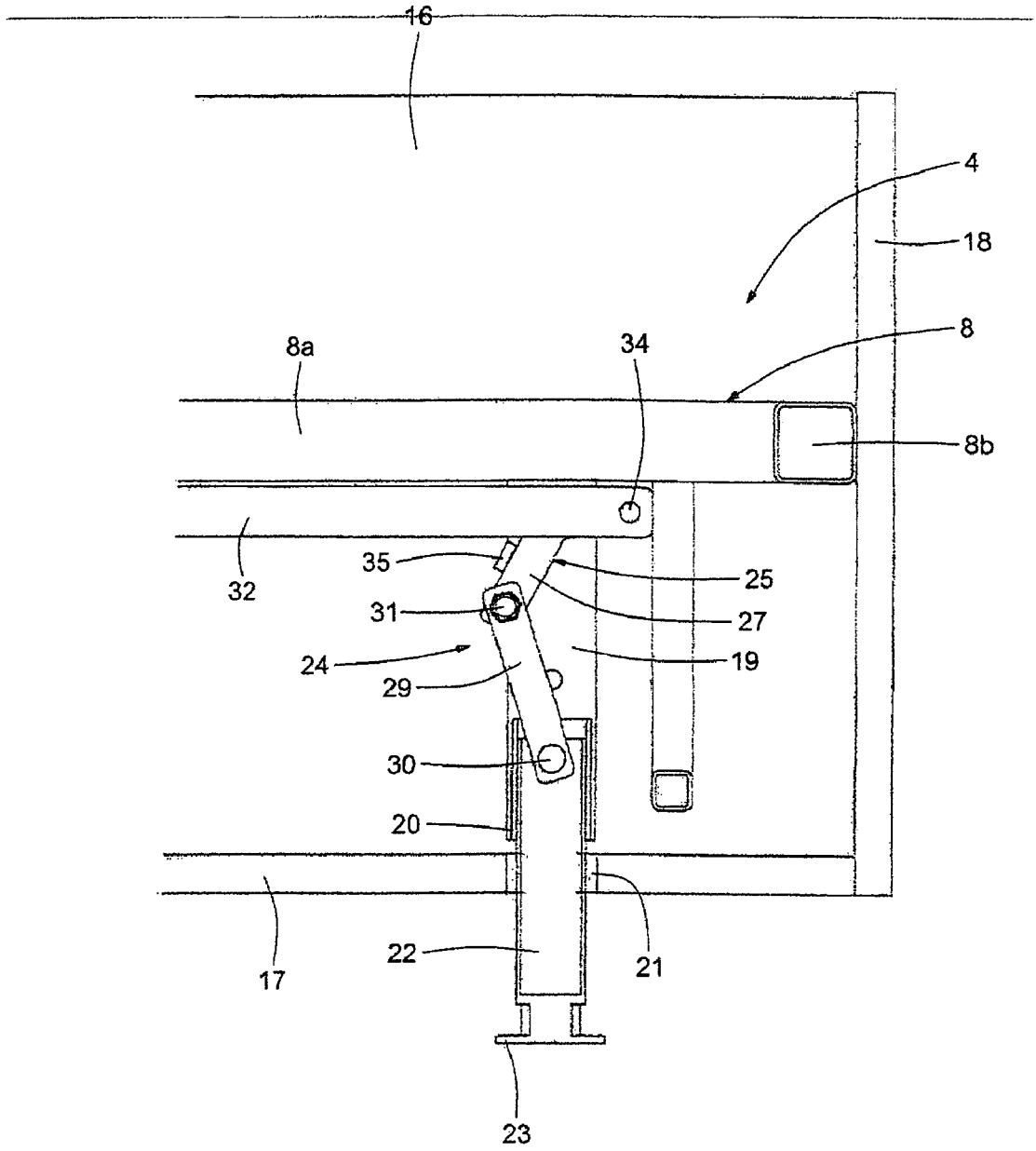
Figure 7:
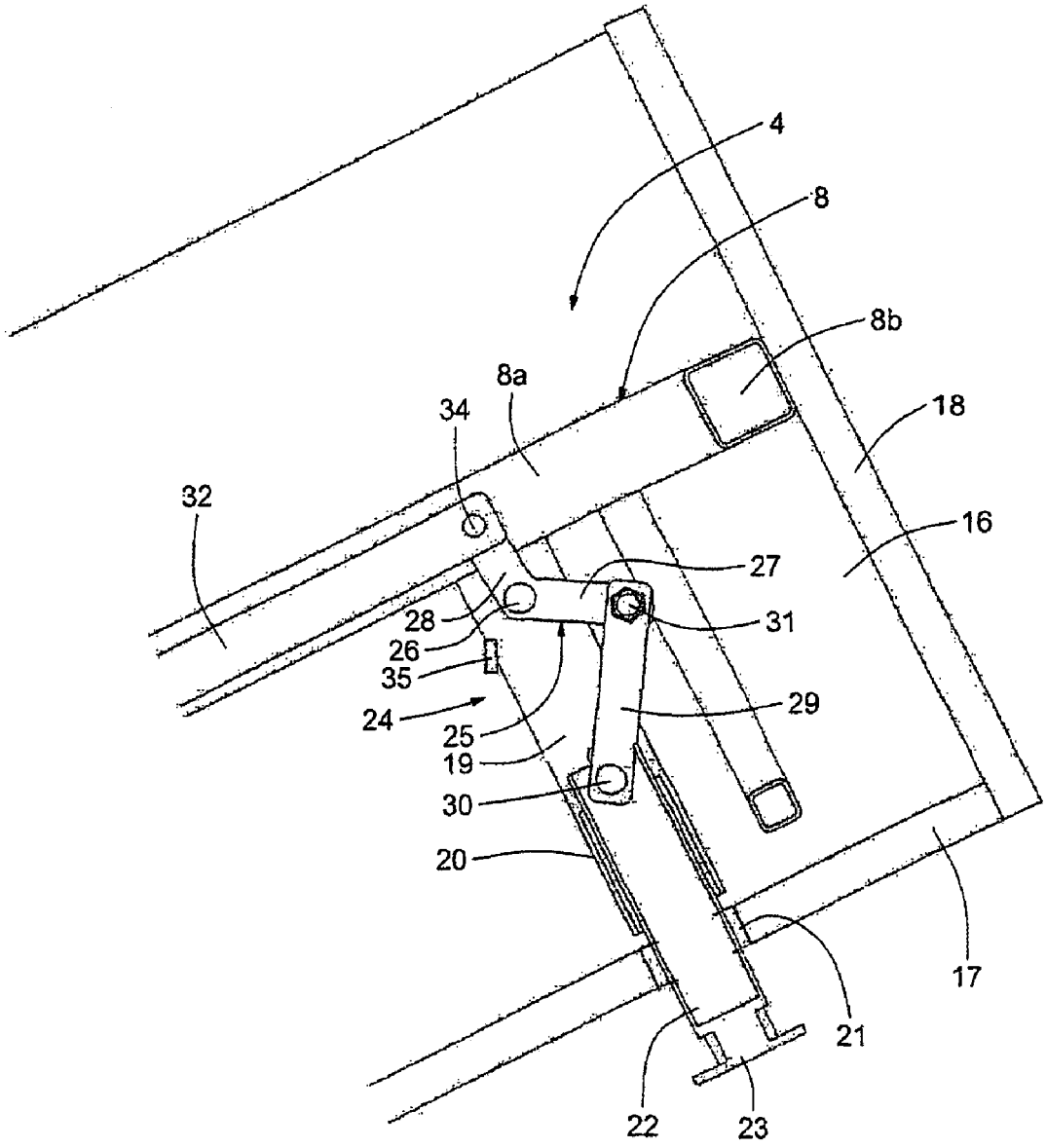
Figure 8:
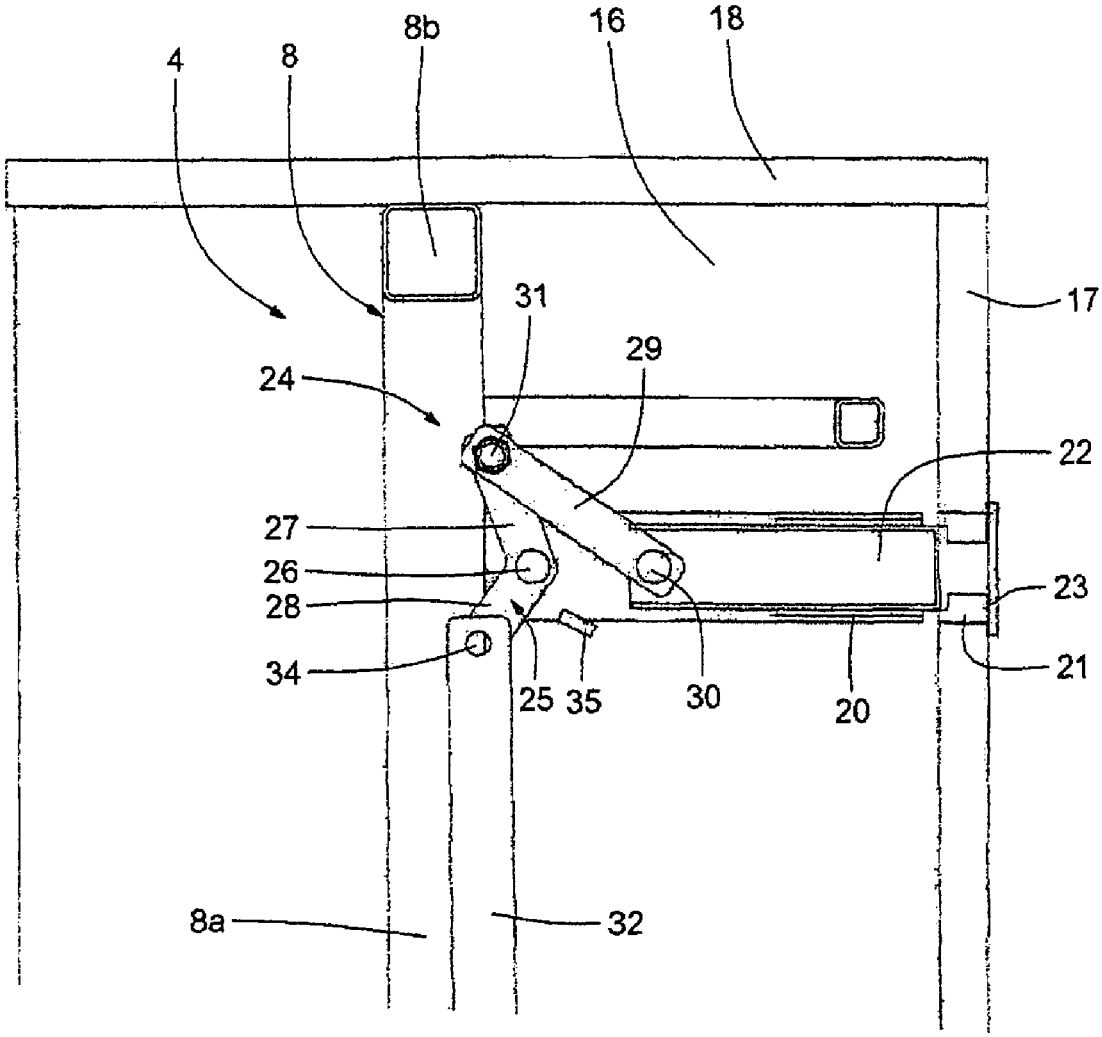

and FIGS. 6, 7 and 8 are partial side views, in the lowered, intermediate and raised positions, respectively of the leg and of its actuating means from FIG. 5.

The illustrated structure 1 for a foldable or fold-up bed comprises a fixed support 2 with two side boards 3 positioned at a distance from each other and a pivoting frame 4 that has a part engaged between these boards 3 and that pivots on the latter via a transverse pivot pin 5.

The fixed support 2 comprises crossmembers 6 connected to the boards 3 and designed to be in contact with the floor and/or a wall and to enable it to be secured by for example screws passing through them.

The fixed support 2 also comprises a transverse reinforcing bar 7 connected to the boards 3 below the pivot pin 5.

The pivoting frame 4 comprises an approximately rectangular chassis 8 made up of side bars 8*a*, rear and front transverse bars 8*b*, and intermediate bars forming a cross 9 connected to the bars 8*a* and 8*b*.

The pivoting frame 4 also comprises lower transverse bars 10 located approximately at the two ends and in the middle of the chassis 8, the ends of the bars being connected to the side bars 8*a* of this chassis.

Actuating means (for pivoting the frame 4 between a horizontal lowered position of use in which the chassis 8 extends forward and a folded position in which the chassis 8 is raised vertically) comprise lateral pneumatic power-assist cylinders 11 installed between the reinforcing bar 7 and the side bars 8*a* of the chassis 8 and an actuating cylinder 12, controllable by a user, installed between the middle of the reinforcing bar 7 and the central bar 9*a* of the cross 9 parallel to the side bars 8*a*.

The structure 1 also comprises a fixed enclosing means which particularly comprises lower side panels 13 attached to the outsides of the boards 3, and upper side panels 14 which continue upward from the lower side panels 13, their forward edges being set back from the forward vertical edges of the lower side panels 13. A vertical rear transverse wall 14*a* connects the upper panels 14.

The structure 1 also comprises an enclosing means mounted on the frame 4, which includes in particular an enclosing box 15 whose rear part is engaged between the boards 3.

This box 15 comprises side walls 16, a front wall 17 which lies over the floor when the box is in its lowered position and is fixed to the transverse bars 10 of the frame 4 to leave a space between the chassis 8 and the front wall 17 in which the cylinders 11 and 12 can be housed, and a forward transverse wall 18 at the free forward end of the frame 4 and a rear transverse wall 18*a* at the free rear end of the frame 4.

In the folded position, therefore, the box 15 engages between the lower panels 13 and in part between the upper panels 14, so that the structure 1 looks like a wardrobe, the upper edge of the rear wall 18*a* being close to the lower edge of the rear wall 14*a*.

The forward parts (situated in the area of the forward wall 18), of the side bars 8*a* of the chassis 8 are provided with plates 19 that extend toward the front wall 17 and that support in the vicinity of this wall and facing one another, portions of square-section tubular bars 20 acting as guides perpendicular to the plane of the chassis 8 and of the front wall 17.

The front wall 17 has square through passages 21 in front of the tubular bars 20.

Mounted inside the tubular bars 20 are retractable square-section legs 22 designed to be able to slide at right angles to the plane of the chassis 8 and to that of the front wall 17 through the passages 21.

The legs 22 project at either end from the tubular bars 20 and their ends on the outside of the front wall 17 are fitted with square plates 23 larger than the passages 21, these plates preferably being adjustable on the legs in the direction in which the latter slide, using for example screw-nut systems, so that the length of the legs is adjustable.

The inner ends of the legs 22 are connected to actuating means 24 positioned in the space between the chassis 8 and the front wall 17 and constructed in the following manner.

The actuating means comprise pivoting members 25 mounted on the plates 19 via transverse pins 26 and comprising two arms 27 and 28 in the shape of an obtuse-angled L.

The arms 27 are connected to the inner end of the legs 22 via links 29: these are hinged to the legs 22 by transverse hinge pins 30 and to the arms 27 by transverse hinge pins 31.

The arms 28 are connected remotely to the reinforcing bar 7 via long links 32 hinged to the reinforcing bar 7 by transverse hinge pins 33 and to the arms 28 by transverse hinge pins 34.

The dimensions of the actuating means 24 are such that a pivoting of the frame 4 will cause the legs to slide inside the guides 20 owing to the changing distance between the transverse pins 26 and the transverse pins 34 and because of the resulting rotation of the pivoting members 25.

When the frame 4 is placed in its lowered position, the legs are placed in an extended position, visible in FIG. 6, in which the end plates 23 rest on the floor, near the forward corners of the frame 4.

When the frame 4 is placed in its raised position, the legs are placed in a withdrawn position, visible in FIG. 8, in which the plates 23 are close to the outer face of the front wall 17, preferably in contact with the latter, after passing through intermediate positions visible in FIG. 7. The legs 22 are thus no longer visible.

Advantageously, when the legs 22 move between their extended and withdrawn positions, the transverse pins 34 connecting the arms 28 to the links 32 are situated on one side of the plane passing through the transverse pins 33 connecting the links 32 to the reinforcing bar 7 of the fixed support 2 and the transverse pins 26 connecting the pivoting members 25 to the chassis 8 of the pivoting frame 4.

Additionally, when the legs 22 are placed in their extended position, the transverse pins 31 pass slightly beyond their position of alignment with the transverse pins 26 and 30 and the arms 27 bear on the limit-of-travel and collapse-prevention stops 35, the stops 35 being mounted on the plates 19. In this way the arms 27 and the links 29 produce a toggle action.

The present invention is not limited to the particular example of an embodiment described above. The fixed part and the pivoting part of the structure could be of different designs. For example, the pivoting part could be a thick front door of a piece of furniture. The shapes and arrangements of the guides and sliding legs could be different. The actuating means could also be different. Many variants are thus possible without going outside the scope of the appended claims.

The invention claimed is:

1. A structure for a piece of furniture, the structure comprising: a fixed part configured to be placed on a floor surface; and a pivoting part distant from the floor surface, wherein the pivoting part comprises an essentially flat frame hinged to the fixed part by a transverse pivot pin (5), the frame pivotable between an essentially vertical raised position and an essentially horizontal lowered position, said pivoting part further comprising i) a leg (22) able to be in contact on the floor surface when the frame is in the lowered position, ii) a guide (20) which is affixed to said frame and receiving the leg (22) so that the leg (22) is slidable at a right angle to said frame (4), iii) an actuating means (24) connecting the leg to said fixed part, to move the leg between an extended position when said pivoting part is in the lowered position a free end of the leg is standing on the surface and to a withdrawn position when the frame is in the raised position, and iv) a limit-of-travel and collapsed-prevention stop (35) carried by the frame, wherein, the actuating means comprises a member (25) pivoting on the frame and having a first arm (27) connected to the leg (22) by a first link (29) and a second arm (28) connected to the fixed part by a second link (32), a first pivoting pin (26) connects the member (25) on the frame, a second pivoting pin (31) connects the first arm (27) and the first link (29) and a third pivoting pin (30) connects the first link (29) and the at least one leg (22), the first pivoting pin (26) is under a third pivoting pin (30) with respect to the frame, the first pivoting pin (26) and the third pivoting pin (30) are one over the other at a distance with respect of the frame, the second pivoting pin (31) passes slightly beyond a position of alignment of the first pivoting pin (26) and the third pivoting pin (30), when the leg is in the extended position, and the pivoting pin (31) is stopped by the limit-of-travel and collapse prevention stop (35) to produce a toggle action of the first arm (27) and the first link (29) when the leg is in the extended position in contact on said floor surface in order to avoid sliding movement of the leg toward the retracted position.

2. The structure as claimed in claim 1, wherein the pivoting part comprises a front wall (17) which faces the surface when in the lowered position, the at least one leg (22) extending through the front wall in a withdrawn position to position the free end close to the front wall.

3. The structure as claimed in claim 2, characterized in that said front wall (17) and said frame (4) define a space in which said actuating means (24) are located.

4. The structure as claimed in claim 2, wherein the free end of the at least one leg (22) has an end plate (23) which is close to or in contact with a front face of said front wall (17) when the at least one leg is moved into the withdrawn position.

5. The structure as claimed in claim 1, wherein when the at least one leg (22) is both in the extended position and in the withdrawn position, the pivoting pin (34) connected to the second arm (28) connected to the second link (32) is not aligned with the pivoting pin (33) connected to the second link to said fixed part (7) and the pivoting pin (26) connected to said member (25) to said pivoting part (4).

6. The structure as claimed in claim 1, wherein when the at least one leg (22) moves between the extended position and the withdrawn position, the pivoting pin (34) connected to the second arm (28) to the second link (32) is on one side of a plane passing through the pivoting pin (33) connecting the second link to said fixed part (7) and the pivoting pin (26) connecting said member (25) to said pivoting part (4).

7. The structure as claimed in claim 1, characterized in that said guide (20) comprises a tubular part in which said leg slides.

8. The structure as claimed in claim 7, characterized in that said tubular part (20) and the at least one leg (22) have square cross sections.

9. The structure as claimed in claim 1, wherein a length of the at least one leg (22) is adjustable.

10. The structure as claimed in claim 1, wherein said fixed part comprises two side boards (3), and the frame of the pivoting part is supported by said fixed part via a transverse pivot pin (5), said side boards are connected by a transverse reinforcing bar (7) connected to the two side boards and located in a region below said transverse pivot pin (5), and said actuating means (24) are connected to the reinforcing bar.

11. A structure for a piece of furniture, the structure comprising:

a fixed support (2) with i) two side boards (3) positioned at a distance from each other and ii) crossmembers (6) connected to each of the two boards (3), the crossmembers configured to be placed on a floor surface;

a pivoting frame (4) engaged between the two boards (3), the pivoting frame 4 comprising a rectangular chassis (8, 8*a*, 8*b*, 9);

a transverse pivot pin (5), the frame pivotable between the two boards via the transverse pivot pin, the frame pivotable between an essentially vertical raised position and an essentially horizontal lowered position;

a transverse reinforcing bar (7) connected to the two boards (3) at a location below the pivot pin (5);

an actuating means (24) pivoting the frame (4) between the horizontal lowered position and the vertical raised position, the actuating means comprising i) lateral pneumatic cylinders (11) attached to and between the reinforcing bar 7 and side bars (8*a*) of the chassis (8), and ii) a user-controllable actuating cylinder (12) attached to and between a middle location of the reinforcing bar (7) and a central bar (9*a*) of the chassis (8);

guides (20) affixed to the frame;

legs (22) connected to the actuating means (24) and able to be in contact on the floor surface when the frame is in the lowered position, the legs (22) projecting through the guides guides (20) and slidable at a right angle to said frame (4);

pivoting members (25) mounted on chassis (8) via a first pivoting pin (26), the pivot members comprised of i) a first arm (27) and ii) a second arm (28) connected to the transverse reinforcing bar (7);

a link (29) connected to the first arm (27) by a second pivoting pin (31), the link (29) connected to the leg (22) by a third pivoting pin (30), the first pivoting pin (26) being closer to the chassis than the third pivoting pin (30); and a limit-of-travel and collapsed-prevention stop (35) carried by the fixed support, wherein, with the legs (22) in an extended position, the second pivoting pin (31) passes beyond a position of alignment with the first and third pivoting pins (26, 30) and the first arm (27) bears on the limit-of-travel and collapse-prevention stop (35), so that the first arm (27) and the link (29) produces a toggle action.

* * * * *